United States Patent [19]

Okumoto et al.

[11] Patent Number: 5,009,423

[45] Date of Patent: Apr. 23, 1991

[54] WOOD GOLF CLUB AND ITS PRODUCTION METHOD

[75] Inventors: Takaharu Okumoto, Chigasaki; Tadashi Hayashida, Hiratsuka; Kazuo Kawada, Hiratsuka; Tetsuo Hayashi, Hiratsuka, all of Japan

[73] Assignee: The Yokohama Rubber Co., Ltd., Tokyo, Japan

[21] Appl. No.: 506,214

[22] Filed: Apr. 9, 1990

[30] Foreign Application Priority Data

Apr. 10, 1989 [JP] Japan ..... 1-40963
Dec. 12, 1989 [JP] Japan ..... 1-320447

[51] Int. Cl.[5] ..... A63B 52/10
[52] U.S. Cl. ..... 273/80.2; 273/80 R
[58] Field of Search ..... 273/80 R, 80 A, 80 B, 273/ 80 C, 80 D, 80.1, 80.2, 80.3, 80.4, 80.5, 80.6, 80.7, 80.8, 80.9

[56] References Cited

U.S. PATENT DOCUMENTS 1,644,510 10/1927 Buhrke ..... 273/80.3
2,361,415 10/1944 Reach ..... 273/80.5
3,140,094 7/1964 Hings ..... 273/80.3
3,614,101 10/1971 Hunter ..... 273/80.2
4,664,383 5/1987 Aizawa ..... 273/80.3
4,757,997 7/1988 Roy ..... 273/80 R

FOREIGN PATENT DOCUMENTS 362008 of 1931 United Kingdom ..... 273/80.5
573330 of 1945 United Kingdom ..... 273/80

*Primary Examiner*—Edward M. Coven
*Assistant Examiner*—Raleigh W. Chiu
*Attorney, Agent, or Firm*—Finnegan, Henderson, Farabow, Garrett & Dunner

[57] ABSTRACT

This invention relates to a wood golf club and its production method, wherein an outer peripheral surface recessed from an outer surface of a club head main body through a step is formed on a neck portion of a club head made of a fiber-reinforced resin, a long-fiber-reinforced resin layer formed by winding resin-impregnated long fibers in such a manner as to cross the axial direction of the neck portion is fitted over the outer peripheral surface, and the outer surface of the long-fiber-reinforced resin layer and the outer surface of the club head main body are at substantially the same level.

11 Claims, 3 Drawing Sheets

WOOD GOLF CLUB AND ITS PRODUCTION METHOD

BACKGROUND OF THE INVENTION

This invention relates to a wood golf club whose club head is molded from a fiber-reinforced resin as its principal material and to a production method thereof. More particularly, the present invention relates to a wood golf club and its production method for reinforcing a neck portion, which is molded integrally with a club head from a fiber-reinforced resin, while keeping its good appearance.

A wood golf club is produced by molding integrally a club head main body having a ball hitting face and a neck portion and connecting a club shaft to the neck portion. Besides a unitary structure of the club head main body and the neck portion that are cut out from a wood, the club head main body and the neck portion molded integrally from a fiber-reinforced resin or a metal have recently been put on the market. With the exception of the club head molded from a metal, these wood golf clubs have a structure wherein yarn 4 are densely wound on the outer periphery of the neck portion 2 for reinforcement when the club shaft 3 is connected to the neck portion 2 which is integral with the club head main body 1 as shown in FIG. 9.

However, since the yarn 4 are wound, the diameter of the neck portion 2 becomes great as a whole and this neck portion 2 having such a large diameter becomes sometimes an offense to the eye at the time of hitting of the ball. Since the yarn 4 sometimes get loose, the drop of the reinforcing effect and the drop of appearance occur eventually.

SUMMARY OF THE INVENTION

In a wood golf club of the type wherein the club head main body and the neck portion are integrally molded from a fiber-reinforced resin as a principal material, it is an object of the present invention to provide a wood golf club which reduces the diameter of the neck portion to such an extent that it does not become an offence to the eye at the time of hitting of the ball and yet has a high reinforcing effect.

It is another object of the present invention to provide a wood golf club which does not use yarn for reinforcing the neck portion and thus eliminates the drop of the reinforcing effect and deterioration of appearance due to loosening of the yarn.

It is still another object of the present invention to provide a production method capable of easily producing a wood golf club having the features described above.

To accomplish the objects described above, the wood golf club in accordance with the present invention has a structure wherein an outer peripheral surface recessed from the outer surface of the club head main body is formed on the neck portion through a step, a long-fiber-reinforced resin layer formed by winding resin-impregnated long fibers in such a manner as to cross the axial direction of the neck portion is fitted over this outer peripheral surface and the outer surface of the long-fiber-reinforced resin layer and the outer surface of the club head main body are at substantially the same level.

According to the structure described above, the outer surface of the neck portion is at the same level as the outer surface of the club head main body and the outer diameter of the neck portion can be reduced remarkably in comparison with the neck portion of a conventional wood golf club. Therefore, the neck portion does not become an offense to the eye at the time of hitting of the ball. Since the yarn as required in the conventional wood golf clubs are not provided on the outer surface of the neck portion, the troubles resulting from loosening yarn can be eliminated and a highly reliable reinforcing effect and good appearance can therefore be secured.

In the present invention, the long fibers that constitute the long-fiber-reinforced resin layer may only be wound in such a fashion as to cross the axial direction of the neck portion and its formation structure is not particularly limitative. A preferred formation structure is a knit reinforcing layer structure wherein the long fibers are knit in a cylindrical shape. It may be also a structure wherein a large number of aligned long fibers are laminated in multiple layers.

The production method of the wood golf club described above comprises as follows. First of all, a club head is produced by integrally molding a club head main body having a ball hitting face and a neck portion having an outer peripheral surface which is recessed from the outer surface of the club head main body through a step from a fiber-reinforced resin as a principal material. On the other hand, a long-fiber-reinforced resin layer is formed from a knit reinforcing layer, which is obtained by knitting long fibers in a cylindrical shape in conformity with the shape of the outer peripheral surface of the neck portion, and a resin. Then, a club shaft is fitted to the neck portion of the club head and the long-fiber-reinforced resin layer is fitted over the outer peripheral surface of the neck portion and they are integrated with one another.

DESCRIPTION OF THE PREFERRED EMBODIMENTS

Figure 1:
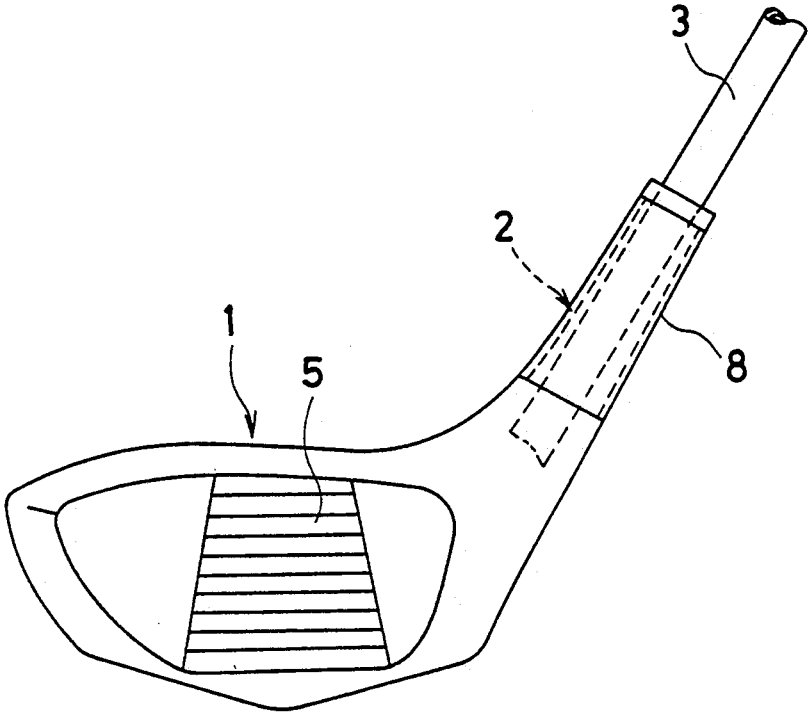
FIG. 1 is a front view of a wood golf club in accordance with an embodiment of the present invention.

In the wood golf club of the present invention shown in FIG. 1, reference numeral 1 represents a club head main body; 2 is a neck portion; and 3 is a club shaft. The club head main body 1 has a ball hitting face 5 on its front surface and is integrally molded with the neck portion 2 from a fiber-reinforced resin as a principal material. The club shaft 3 is fitted and connected to the neck portion 2 of the club head thus molded integrally, and the outer periphery of the neck portion 2 is reinforced by a long-fiber-reinforced resin layer 8.

Figure 2:
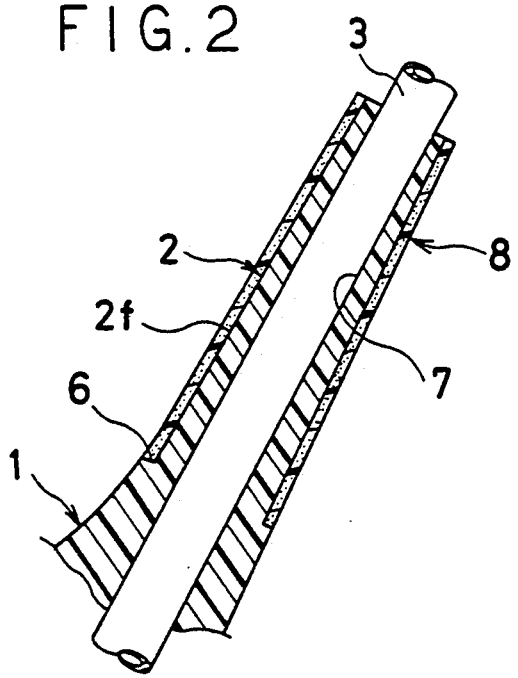
FIG. 2 is a longitudinal sectional view of a neck portion of the wood golf club described above.
Figure 3:
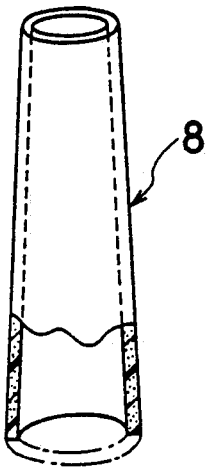
FIG. 3 is a partially cut away perspective view of a cylindrical long-fiber-reinforced resin layer to be fitted to the neck portion shown in FIG. 2.

FIG. 2 shows in detail the neck portion 2 of the wood golf club described above. A fitting hole 7 is formed at the inner center of the neck portion 2 and the club shaft 3 is fitted into the fixed to this fitting hole 7. The outer peripheral surface 2*f* of the neck portion 2 is shaped in a recessed cylindrical surface lower than the outer surface of the club head main body 1 through a step 6. The cylindrical long-fiber-reinforced resin layer 8 is fitted over the outside of this outer peripheral surface 2*f* so as to reinforce the neck portion 2. The long-fiber-reinforced resin layer 8 consists of long fibers and a resin. The long fibers are wound in such a manner as to cross the axial direction of the neck portion 2 and forms a cylindrical knit reinforcing layer. The crossing angle of the long fibers to the axial direction of the neck portion 2 is preferably within the range of 45° to 135° and among others, a crossing angle of about 90° is most preferred.

Figure 9:
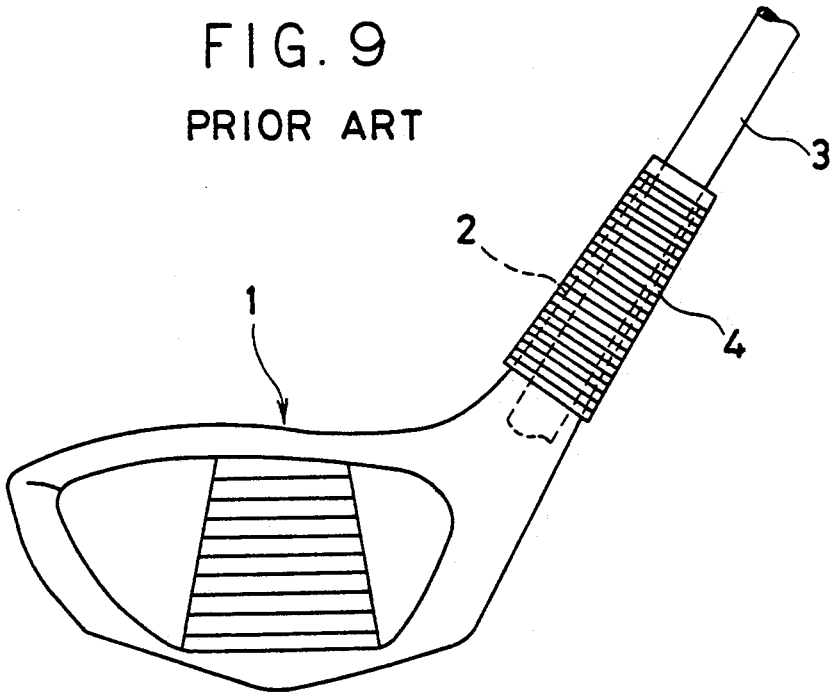
FIG. 9 PRIOR ART
FIG. 9 is a front view of a conventional wood golf club.

The neck portion 2 is provided with a high reinforcing effect by the long-fiber-reinforced resin layer 8. Since the outer peripheral surface of the long-fiber-reinforced resin layer 8 is at the same level as the outer surface of the club head main body 1, the diameter of the neck portion 2 becomes smaller than that of the conventional wood golf club shown in FIG. 9 and is not an offense to the eye. Since no yarn are wound on this neck portion 2, troubles such as deterioration of appearance due to loose yarn do not occur.

Fibers selected from a group consisting of carbon fibers, glass fibers and aromatic polyamide fibers are used preferably as the long fibers for constituting the long-fiber-reinforced resin layer described above. A thermosetting resin selected from a group consisting of unsaturated polyester resins, vinyl ester resins and epoxy resins is used preferably as the matrix resin. However, thermoplastic resins such as ABS resins, nylon resins, polyethylene resins, and the like, can also be used as the matrix resin.

The production of the wood golf club whose neck portion is reinforced by such long-fiber-reinforced resin layer is carried out in the following way. First of all, a club head is molded by integrating both the club head main body and the neck portion from the fiber-reinforced resin as the principal material and a cylindrical knit reinforcing layer is then knit from reinforcing long fibers impregnated with resin, or so-called "prepreg", so as to prepare the long-fiber-reinforced resin layer. The cylindrical long-fiber-reinforced resin layer thus prepared is inserted into the neck portion of the club head to be fitted over and integrated with the outer peripheral surface of the neck portion.

To fit and fix the long-fiber-reinforced resin layer to the neck portion of the club head, the club head and the long-fiber-reinforced resin layer are bonded mutually by an adhesive after their resins are cured. More preferably, the resin of at least one of these components is left uncured and both of them are then fitted to each other and heat-curing of the resins is then conducted so as to simultaneously carry out the curing step of the resins and the bonding step. This method can simplify the production steps. The component whose resin is to be left uncured in this method is preferably the long-fiber-reinforced resin layer. Needless to say, it is possible to fit both the club head and the long fiber-reinforced resin layer while their resins are left uncured and then to carry out heat-curing.

Figure 4:
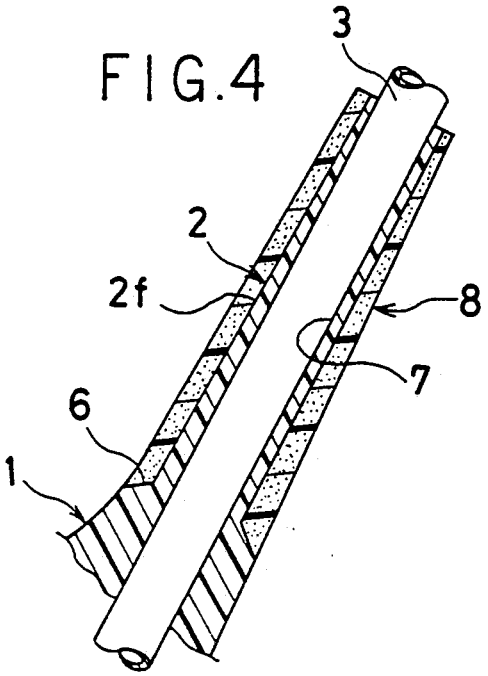
FIG. 4 is a longitudinal sectional view of the neck portion in another embodiment of the present invention.
Figure 5:
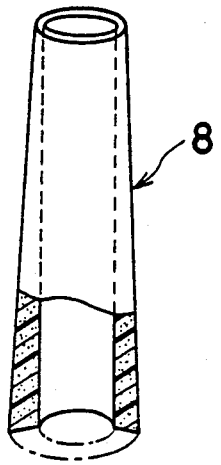
FIG. 5 is a partially cut away perspective view of a cylindrical long-fiber-reinforced resin layer to be fitted over the neck portion shown in FIG. 4.

FIG. 4 shows the structure of the neck portion in another embodiment of the present invention. In this embodiment the thickness of the long-fiber-reinforced resin layer 8 is great at the base portion of the neck portion 2 and decreases progressively towards the tip side as shown in FIG. 5. If the thickness of the long fiber-reinforced resin layer 8 is gradually greater toward the base portion of the neck portion 2 in this manner, the reinforcing effect of the neck portion can be further improved. The long-fiber-reinforced resin layer having such a varying thickness can be obtained easily by forming the knit reinforcing layer of the long fibers as its core material in a three-dimentional woven fabric structure.

Figure 6:
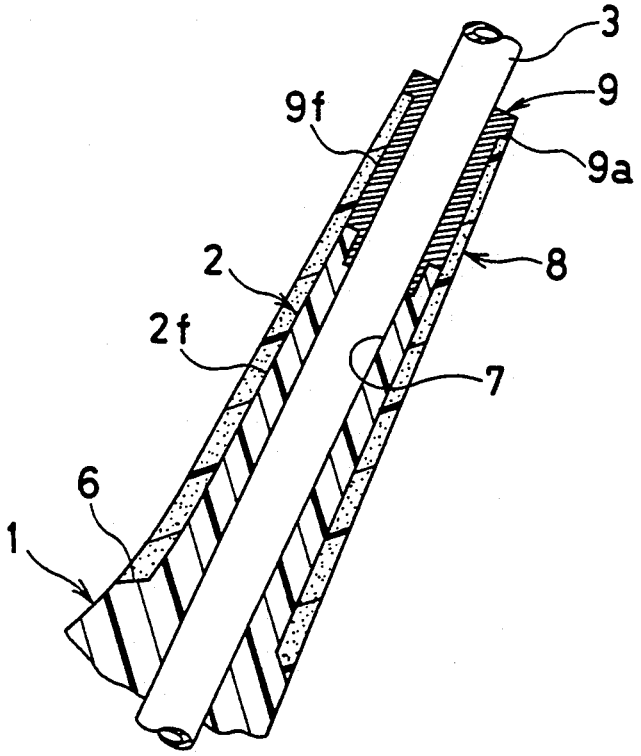
FIGS. 6 to 8 are longitudinal sectional views of the neck portion in other embodiments of the present invention, respectively.

FIG. 6 shows the neck portion 2 in still another embodiment of the present invention. In the neck portion 2 of this embodiment, the long-fiber-reinforced resin layer 8 is not formed from the knit reinforcing layer but is formed by laminating prepregs or in other words, a large number of resin-impregnated aligned long fibers, in multiple layers.

When the long-fiber-reinforced resin layer 8 is thus formed by winding a large number of aligned long fibers on the outer peripheral surface 2*f* of the neck portion 2, it is advisable to dispose a socket 9 having a flange 9*a* for preventing fall-off of the long-fiber-reinforced resin layer 8 to the tip of the neck portion 2 as shown in FIG. 6. This socket 9 has an outer peripheral surface 9*f* having the same diameter as that of the outer peripheral surface 2*f* of the neck portion 2 so that the long-fiber-reinforced resin layer 8 wound on the outer peripheral surface 2*f* of the neck portion 2 can be wound up to this outer peripheral surface 9*f*, too.

Figure 7:
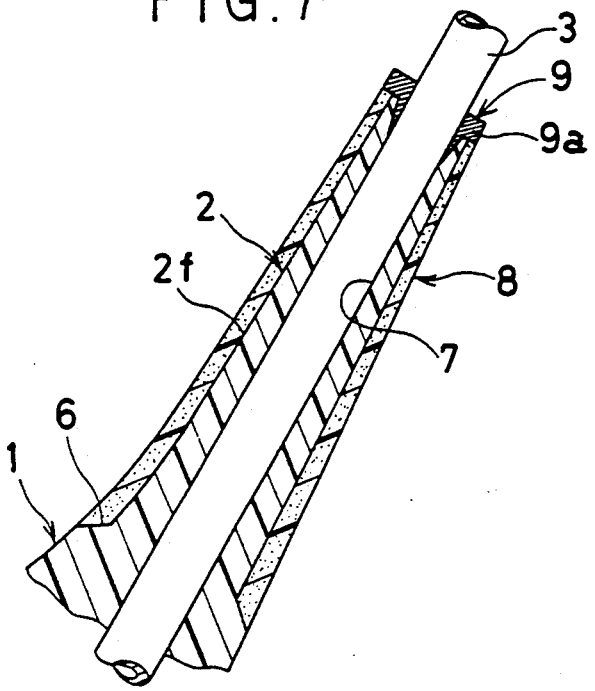
Figure 8:
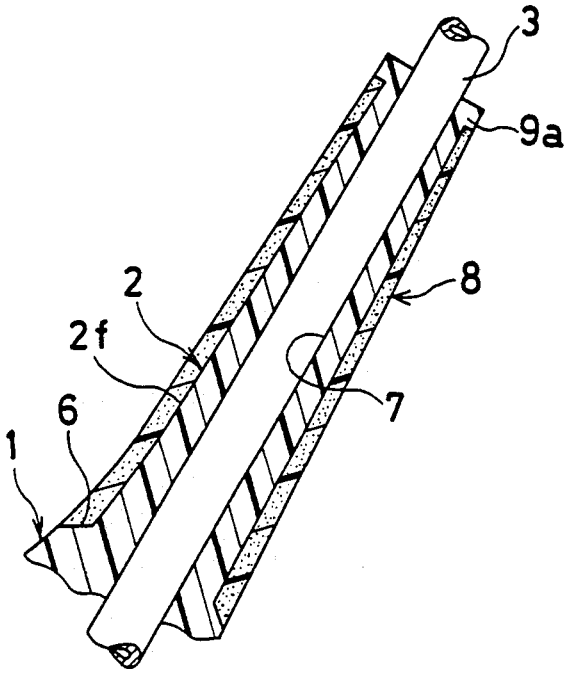

As represented by an example shown in FIG. 7, this socket 9 may be of a compact socket not having the outer peripheral surface 9*f*. Such a small socket can be conveniently applied to a club head having a relatively great length of the neck portion 2 in the axial direction. It is also possible to form directly and integrally the flange 9*a* at the tip of the neck portion 2 as represented by an example shown in FIG. 8 without fitting such a socket 9.

In the case of the neck portions of other embodiments described above, too, the high reinforcing effect can be provided by winding the long-fiber-reinforced resin layer 8. Since the outer peripheral surface of the long-fiber-reinforced resin layer 8 is at the same level as the outer surface of the club head main body 1, the outer diameter of the neck portion can be reduced and the long-fiber-reinforced resin layer 8 is not an offense to the eye at the time of hitting the ball. Since no twist yarns are used, there does not occur the problem of the deterioration of appearance due to loose twist yarns.

What is claimed is:

1. A wood golf club consisting essentially of a club head having a ball hitting face and a club shaft connected to said club head through a neck portion, wherein the main body of said club head and said neck portion are molded integrally from a fiber-reinforced resin as a principal material; said neck portion has an outer peripheral surface recessed from the outer surface of said club head main body through a step; a long-fiber-reinforced resin layer consisting of resin-impregnated long fibers wound so as to cross the axial direction of said neck portion is fitted over said outer peripheral surface; and the outer surface of said long-fiber-reinforced resin layer and the outer surface of said club head main body are substantially at the same level.

2. A wood golf club according to claim 1, wherein said long fibers forming said long-fiber-reinforced resin layer form a cylindrical knit reinforcing layer.

3. A wood golf club according to claim 2, wherein the thickness of said knit reinforcing layer is great at the base portion of said neck portion and decreases progressively towards the tip side.

4. A wood golf club according to claim 1, wherein said long-fiber-reinforced resin layer consists of a large number of aligned long fibers that are wound in multiple layers in such a manner as to cross transversely the axial direction of said neck portion.

5. A wood golf club according to claim 4, wherein a flange for limiting the edge of said long-fiber-reinforced resin layer is disposed at the tip of said neck portion.

6. A wood golf club according to claim 1, wherein said long fibers forming said long-fiber-reinforced resin layer are the fibers selected from a group consisting of carbon fibers, glass fibers and aromatic polyamide fibers.

7. A wood golf club according to claim 1, wherein said resin forming said long-fiber-reinforced resin layer is a thermosetting resin selected from a group consisting of unsaturated polyester resins, vinyl ester resins and epoxy resins.

8. A production method of a wood golf club comprising:

molding integrally a club head main body having a ball hitting face and a neck portion having an outer peripheral surface recessed from the outer surface of said club head main body through a step by use of a fiber-reinforced resin as a principal material to form a club head;

forming a long-fiber-reinforced resin layer from a knit reinforcing layer obtained by knitting long fibers in a cylindrical form in conformity with the shape of the outer peripheral surface of said neck portion and from a resin; and fitting said long-fiber-reinforced resin layer over to the outer peripheral surface of said neck portion of said club to integrate them together.

9. A production method of a wood golf club according to claim 8, wherein said long-fiber-reinforced resin layer is fitted over the outer peripheral surface of said neck portion under the state where at least one of the resin of said fiber-reinforced resin forming said club head and the resin of said long-fiber-reinforced resin layer is left uncured, and then said uncured resin is heated and cured.

10. A production method of a wood golf club according to claim 8, wherein said long fibers forming said long-fiber-reinforced resin layer are the fibers selected from a group consisting of carbon fibers, glass fibers and aromatic polyamide fibers.

11. A production method of a wood golf club according to claim 8, wherein said resin forming said long-fiber-reinforced resin layer is the resin selected from a group consisting of an unsaturated polyester resin, a vinyl ester resin and an epoxy resin.

* * * * *